US011166353B2

(12) United States Patent
Schuyler et al.

(10) Patent No.: US 11,166,353 B2
(45) **Date of Patent: *Nov. 2, 2021**

(54) INTEGRATED PROGRAMMABLE EFFECT AND FUNCTIONAL LIGHTING MODULE

(71) Applicant: W Schonbek LLC, Port Washington, NY (US)

(72) Inventors: Andrew Schuyler, Colchester, VT (US); Chad Recore, Peru, NY (US); Gaetano Ling, Palo Alto, CA (US); Elger Oberwelz, San Francisco, CA (US); Courtney Song, Saratoga, CA (US); Tobias Toft, San Francisco, CA (US); Aaron Wansch, San Francisco, CA (US); Brian Wong, San Francisco, CA (US); Joseph Fledderman, Endicott, NY (US)

(73) Assignee: W Schonbek LLC

( * ) Notice: Subject to any disclaimer, the term of this patent is extended or adjusted under 35 U.S.C. 154(b) by 0 days.

This patent is subject to a terminal disclaimer.

(21) Appl. No.: 16/745,753

(22) Filed: Jan. 17, 2020

(65) Prior Publication Data

US 2020/0154540 A1 May 14, 2020

Related U.S. Application Data

(63) Continuation of application No. 15/907,957, filed on Feb. 28, 2018, now Pat. No. 10,555,390.

(51) Int. Cl.
*H05B 45/10* (2020.01)
*F21V 5/02* (2006.01)
(Continued)

(52) U.S. Cl.
CPC ..... *H05B 45/20* (2020.01); *H05B 45/60* (2020.01); *F21V 5/02* (2013.01); *F21Y 2115/10* (2016.08); *F21Y 2115/15* (2016.08)

(58) Field of Classification Search
None
See application file for complete search history.

(56) References Cited

U.S. PATENT DOCUMENTS 10,555,390 B2 * 2/2020 Schuyler ..... H05B 45/60
2012/0119657 A1 * 5/2012 Snijder ..... F21S 10/00 315/149

(Continued)

FOREIGN PATENT DOCUMENTS

WO WO2014170292 10/2014
WO WO2016168525 9/2019

OTHER PUBLICATIONS

International Search Report and Written Opinion dated Nov. 27, 2018, of International Application Serial No. PCT/US2018/020244, filed Feb. 28, 2018, 13-pages.

*Primary Examiner* — Dedei K Hammond
(74) *Attorney, Agent, or Firm* — Weiss & Arons LLP

(57) ABSTRACT

Embodiments of the present invention include a lighting fixture(s), a computer program product and a computer-implemented method that include program code executed by a processor(s) that obtains a request to implement a specified lighting pattern in the lighting fixture(s). Each lighting fixture includes effect lighting communicatively coupled to the processor(s) and functional lighting (oriented to illuminate a surface below the lighting fixture) communicatively coupled to the processor(s). The program code identifies the specified lighting pattern in a memory communicatively coupled to the processor(s), which includes a sequence for illuminating a portion of the effect lighting elements. The processor(s) executes the specified lighting pattern in the lighting fixture(s).

19 Claims, 9 Drawing Sheets

(51) Int. Cl.

| | |
|---|---|
| ***H05B 45/20*** | (2020.01) |
| ***H05B 45/00*** | (2020.01) |
| *F21Y 115/15* | (2016.01) |
| *F21Y 115/10* | (2016.01) |

(56) References Cited

U.S. PATENT DOCUMENTS

| | | | | |
|---|---|---|---|---|
| 2014/0001964 | A1* | 1/2014 | Ono | H05B 47/105 315/153 |
| 2015/0300617 | A1* | 10/2015 | Katona | F21V 23/001 362/147 |
| 2016/0286630 | A1 | 9/2016 | Witzgall | |
| 2017/0086280 | A1 | 3/2017 | Boomgaarden et al. | |
| 2017/0299146 | A1* | 10/2017 | Meerbeek | H05B 47/19 |
| 2019/0000242 | A1* | 1/2019 | Didur | A47F 3/001 |
| 2019/0268987 | A1 | 8/2019 | Schuyler et al. | |

* cited by examiner

INTEGRATED PROGRAMMABLE EFFECT AND FUNCTIONAL LIGHTING MODULE

BACKGROUND OF INVENTION

When selecting a lighting system, considerations include both functionality and aesthetics. Consumers desire lighting fixtures that provide light for functional purposes, such as reading and illuminating features of a given space for recreational activities. However, the choice of lighting can also be a design choice, as lighting is an interior design element that can create a feeling in a given space. To change the aesthetic in a given space, a consumer may select lights of varying intensity or temperature. At times, a lighting choice that provides the most advantages in a given space, functionally, is not in keeping with the aesthetic that is desired by the consumer. Thus, flexibility within choices is desirable.

SUMMARY OF INVENTION

Shortcomings of the prior art are also overcome and additional advantages are provided through the provision of a lighting fixture, the lighting fixture comprising: one or more processing circuits; a lighting module communicatively coupled to the one or more processing circuits, comprising: a first plurality of lighting elements comprising effect lighting communicatively coupled to the computing node; a second plurality of lighting elements comprising functional lighting communicatively coupled to the computing node, wherein the lighting elements comprising the second plurality are oriented to illuminate a surface below the lighting fixture; and a memory, in communication with the one or more processing circuits, wherein the memory comprises registers, wherein the registers store one or more programs comprising lighting patterns, wherein each lighting pattern comprises a sequence for illuminating a portion of lighting elements comprising the first plurality of lighting elements, in a predefined order; and program instructions executable by the one or more processing circuits, via the memory to perform a method, the method comprising: obtaining, by the one or more processing circuits, from a client, via a network, a request to implement a specified lighting pattern; identifying, by the one or more processing circuits, in the memory, one or more programs comprising the specified lighting pattern from the one or more programs comprising lighting patterns; and executing, by the one or more processing circuits, the identified one or more programs comprising the specified lighting pattern, wherein the executing comprises implementing the specified lighting pattern in the lighting module.

Shortcomings of the prior art are also overcome and additional advantages are provided through the provision of a computer-implemented method for adjusting functional and effect lighting in one or more lighting fixtures. The method may include: obtaining, by one or more processing circuits, from a client, via a network, a request to implement a specified lighting pattern in one or more lighting fixtures, wherein each lighting fixture comprises: a first plurality of lighting elements comprising effect lighting communicatively coupled to the one or more processing circuits; and a second plurality of lighting elements comprising functional lighting communicatively coupled to the one or more processing circuits, wherein the lighting elements comprising the second plurality are oriented to illuminate a surface below the lighting fixture; and identifying, by the one or more processing circuits, in a memory communicatively coupled to the one or more processing circuits, one or more programs comprising the specified lighting pattern from the one or more programs comprising lighting patterns, wherein the specified lighting pattern comprises a sequence for illuminating a portion of lighting elements comprising the first plurality of lighting elements, in a predefined order; and executing, by the one or more processing circuits, the identified one or more programs comprising the specified lighting pattern, wherein the executing comprises implementing the specified lighting pattern in the one or more lighting fixtures.

Lighting systems, computer program products, and methods relating to one or more aspects of the technique are also described and may be claimed herein. Further, services relating to one or more aspects of the technique are also described and may be claimed herein.

Additional features are realized through the techniques of the present invention. Other embodiments and aspects of the invention are described in detail herein and are considered a part of the claimed invention.

BRIEF DESCRIPTION OF DRAWINGS

One or more aspects of the present invention are particularly pointed out and distinctly claimed as examples in the claims at the conclusion of the specification. The foregoing and objects, features, and advantages of one or more aspects of the invention are apparent from the following detailed description taken in conjunction with the accompanying drawings.

DETAILED DESCRIPTION OF THE INVENTION

Figure 1:
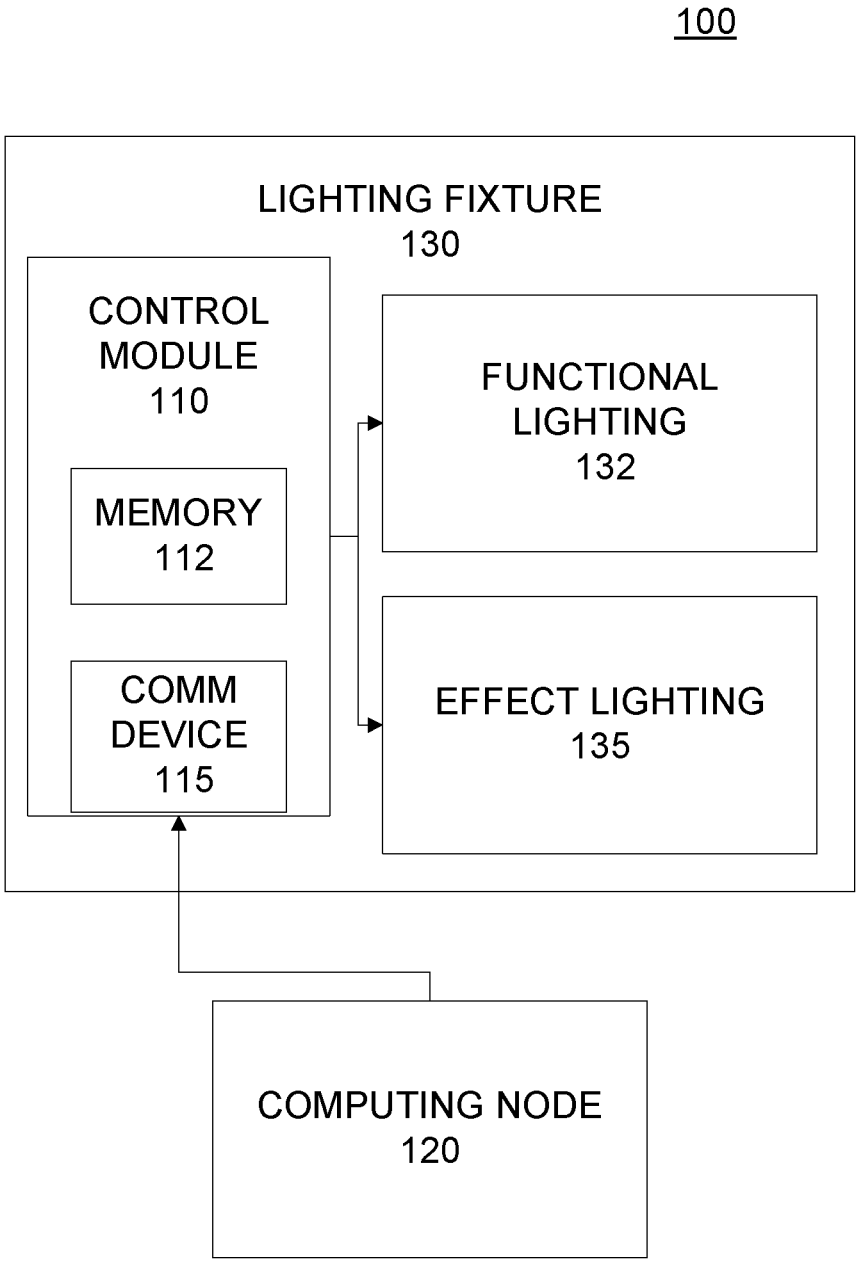
FIG. 1 depicts various aspects of a technical architecture that includes various aspects of some embodiments of the present invention.

Aspects of the present invention and certain features, advantages, and details thereof, are explained more fully below with reference to the non-limiting examples illustrated in the accompanying drawings. Descriptions of well-known materials, fabrication tools, processing techniques, etc., are omitted so as not to unnecessarily obscure the invention in detail. It should be understood, however, that the detailed description and the specific examples, while indicating aspects of the invention, are given by way of illustration only, and not by way of limitation. Various substitutions, modifications, additions, and/or arrangements, within the spirit and/or scope of the underlying inventive concepts will be apparent to those skilled in the art from this disclosure. The terms software, program code, and one or more programs are used interchangeably throughout this application. Program code in certain embodiments of the present invention includes fixed function hardware, while other embodiments utilize a software-based implementation of the functionality described. Certain embodiments combine both types of program code.

Embodiments of the present invention include a computer program product, and a computer implemented method that include program code executing on at least one processing resource that enables the combination and control of functional and effect lighting in one or more lighting fixtures. Further embodiments of the present invention include a lighting fixture with integrated functional and effect lighting, which can be controlled by program code executing on a computing device integrated into the fixture and/or a remote computing node. In some embodiments of the present invention, program code executing on at least one processing resource controls the functionality of the functional lighting and the effect lighting. The program code may provide different instructions to the functional lighting and the effect lighting. In some embodiments of the present invention, certain of the program code is stored in a memory and includes one or more programs that implement pre-defined lighting patterns into the effect lighting. Based on a trigger, such as a user selection or the realization of a predefined condition, the stored one or more programs may be executed and adjust the effect lighting to implement a pattern. In some embodiments of the present invention, one or more programs executing on a processing resource may repeat a pattern indefinitely. Alternatively, one or more programs may terminate a given pattern after a pre-defined time period. Despite the combination of the functional and effect lighting into a single lighting fixture, in embodiments of the present invention, the sources of the functional and effect lighting are configured in the lighting fixture in a manner that prevents the interference of the functional and effect lighting with each other, such that a user can separately utilize both features at a time when both features are active within the lighting fixture.

FIG. 1 is a diagram 100 of certain aspects of some embodiments of the present invention. FIG. 1 provides a broad overview these aspects. As depicted in FIG. 1, some embodiments of the present invention include a lighting fixture 130 that includes both functional lighting 132 and effect lighting 135. In some embodiments of the present invention, the functional lighting 132 and the effect lighting 135 are part of a common single lighting module. In some embodiments of the present invention, the functional lighting 132 and effect lighting 135 are controlled by a common control module 110. Other embodiments of the present invention may utilize a separate control module 110 for each of the functional lighting 132 and the effect lighting 135. Both the functional lighting 132 and the effect lighting 135 may be comprised of light emitting diodes (LEDs) and/or organic light-emitting diodes (OLEDs). The control module 110 may include one or more circuits that control the functional lighting 132 and the effect lighting 135 and at least one memory 112, where one or more programs that comprise predetermined light settings and patterns for both the functional lighting 132 and the effect lighting 135 may be stored. In some embodiments of the present invention, the memory 112 stores registers of data that include various programs to implement pre-determined effects into one or more of the effect lighting 135 and the functional lighting 132.

Across various embodiments of the present invention, the control module 110 includes both software and/or hardware embodiments. For example, the described functionality of the control module 110 may be accomplished by executing software on at least one processor. However, in some embodiments of the present invention, the control module is comprised of specialized hardware and the control module 110 may include one or more circuits that operate the functional lighting 132 and the effect lighting 135. In some embodiments of the present invention, the control module 110 includes application-specific integrated circuits (ASICs). The control module 110 may also comprise a programmable logic device (PLD), which includes both a logic device (e.g., communication device 115) and a memory device (e.g., memory 112). Although FIG. 1 includes single memory 112, further embodiments of the present invention may include more than one memory 112. In the embodiment illustrated by FIG. 1, the memory 112 is used to store one or more patterns that were integrated into the chip during programming. In further embodiments of the present invention, the communication device 115 may obtain one or more patterns based on communicating with additional computing nodes (e.g., on a distributed public or private computing network, such as a cloud), and save the obtained one or more patterns in the memory 112. In some embodiments of the present invention, the control module 110 includes one or more circuit boards, a wireless fidelity (WiFi) chip as the communication device 115, and a memory 112.

Figure 2:
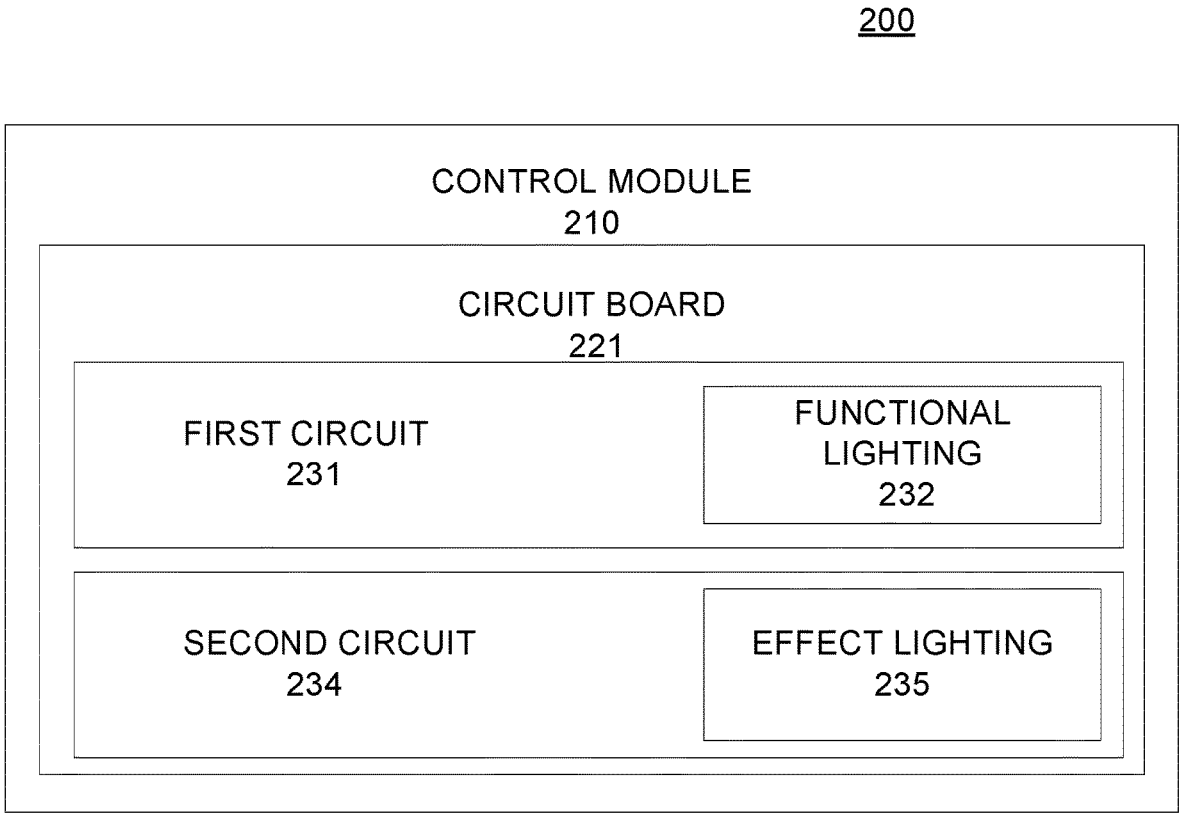
FIG. 2 depicts various aspects of a technical architecture that includes various aspects of some embodiments of the present invention.

FIG. 2 is an example of a control module 110 that can be utilized in some embodiments of the present invention. Referring to FIG. 2, in some embodiments of the present invention, the control module 210 is comprised of a circuit board 221 with a first circuit 231 and a second circuit 241. The first circuit 231 and the second circuit 241 may be connected using various means, including utilizing one or more ribbon cables. Other embodiments of the present invention utilize a dedicated circuit board for each of the individual circuits. FIG. 2 depicts aspects of an embodiment 200 with a control module 210 that includes one circuit board 221. As illustrated in FIG. 2, the first circuit 231, which may be referred to as the functional circuit, includes functional lighting 232, which may be comprised of LEDs and OLEDs. The second circuit 234, which may be referred to as an effect circuit, includes the effect lighting 235. The functionality of the circuit board 231, which includes the first circuit 231 and second circuit 234, is controlled by a computing node which may be a handheld device (not pictured).

Utilizing a handheld device (e.g., a custom remote and/or a standard computing node, such as a personal computing device) to make inputs, a user may adjust the intensity and color temperature, changing the lumen output (amount of light emitted per second) of the functional lighting 232. The first circuit 231 receives inputs from the computing node over a network, including but not limited to, a private and/or a public network, such as the Internet. In some embodiments of the present invention, the inputs may trigger one or more programs in an embodiment of the present invention to implement a pre-defined intensity and color temperature in the functional lighting 232.

In some embodiments of the present invention, the second circuit 234, which controls the effect lighting 235, is programmable, for example, the effect lighting 235 may comprise programmable LEDs and/or OLEDs. By making inputs into aforementioned handheld device, which may include a computing node 120 (FIG. 1), one or more programs in an embodiment of the present invention implement a predetermined lighting pattern into the effect lighting 235. In some embodiments of the present invention, a user may select from a variety of pre-set patterns and one or more programs will implement the selected pattern. In some embodiments of the present invention, a user may utilize a graphical user interface (GUI) on the handheld device to select certain of the effect lighting 235 to generate a new pattern. The user may select an option to implement and repeat the pattern and the handheld device will communicate with the second circuit 234 to implement the generated pattern. In addition to selecting options via a handheld device, to execute different programs that implement various lighting patterns in the effect lighting 235, the handheld device (based on selections of the user or pre-configured preferences coupled with temporal conditions) may communicate with the control module 220 to adjust the color temperature and intensity of the effect lighting 235.

Returning to FIG. 1, in some embodiments of the present invention, the control module 110 may include a separate set of controls for each of the effect lighting 135 and the functional lighting 132. In some embodiments of the present invention, the effect lighting 135 and the functional lighting 132 are a single set of lighting elements, including but not limited to a set of LEDs. Despite the common physical lighting, the functionality that involves effect lighting 135 is separately programmable from the functionality of the functional lighting, such that the control module 110 differentiates and separately controls each function of the shared physical lighting elements that form the effect lighting 135 and the functional lighting 132.

Returning to FIG. 1, the control module 110 may also include a communication device 115 which enables the control module 110 to obtain commands for controlling the functional lighting 132 and the effect lighting 135 from an the handheld device, which may include any external computing node 120, including but not limited to, a personal computing device. The communication device 115 may communicate with the computing node 120 utilizing various forms of wireless communications, including but not limited to WiFi, Bluetooth, infrared, Zigbee, LTE, etc. In some embodiments of the present invention, the computing node 120 and the control module 110 are connected to the same public and/or private network. As aforementioned, the network may be a distributed computing network or a cloud computing network. Each of the computing node 120 and the control module 110 may be nodes on the cloud computing network or distributed network and may utilize the network connections to communicate regarding control of the functional lighting 132 and the effect lighting 135, which may be either communicatively coupled and/or integrated into the control module 110.

In FIG. 1, a computing device 120 is shown as controlling a single lighting fixture 130. However, in some embodiments of the present invention, a computing node 120 may provide (simultaneously or concurrently) commands to the control modules 110 of a variety of lighting fixtures 130. In some embodiments of the present invention, the computing node may provide commands to a control module 110 and the control module 110 may implement program code that controls (simultaneously or concurrently) the functionality of multiple lighting fixtures 130.

The computing node 120 in embodiments of the present invention may include one or more computing nodes that actively and/or passively communicate with the control module 110 over a network, including but not limited to, the Internet. The computing node 120 and/or the control module 110 may include one or more Internet of Things (IoT) devices. As understood by one of skill in the art, the Internet of Things (IoT) is a system of interrelated computing devices, mechanical and digital machines, objects, animals and/or people that are provided with unique identifiers and the ability to transfer data over a network, without requiring human-to-human or human-to-computer interaction. These communications are enabled by smart sensors, which include, but are not limited to, both active and passive radio-frequency identification (RFID) tags, which utilize electromagnetic fields to identify automatically and to track tags attached to objects and/or associated with objects and people. Smart sensors, such as RFID tags, can track environmental factors related to an object, including but not limited to, temperature and humidity. The smart sensors can be utilized to measure temperature, humidity, vibrations, motion, light, pressure and/or altitude. IoT devices also include individual activity and fitness trackers, which include (wearable) devices or applications that include smart sensors for monitoring and tracking fitness-related metrics such as distance walked or run, calorie consumption, and in some cases heartbeat and quality of sleep and include smartwatches that are synced to a computer or smartphone for long-term data tracking. Because the smart sensors in IoT devices carry unique identifiers, a computing system that communicates with a given sensor can identify the source of the information. Within the IoT, various devices can communicate with each other and can access data from sources available over various communication networks, including the Internet.

In some embodiments of the present invention, one or more of the computing node 120 and the control module 110 may communicate with another computing resource (not pictured) to obtain additional program code to utilize in implementing a new pattern in the functional lighting 132. Updates to the patterns may be automatic and based on receiving a message that an update is available, one or more of the computing node 120 and/or the control module 110 may obtain the pattern. The control module 110 may store new patterns in the memory 112.

In some embodiments of the present invention, a user may define and store a state that includes one or more of: a pattern for the effect lighting 135 (including the intensity and/or color temperature of the effect lighting 135 elements participating in the pattern, when executed) and a pre-selected intensity and/or color temperature for the functional lighting 132. As part of the state, one or more of the functional lighting 132 or effect lighting 135 may be set to not be illuminated. For example, in a given state, while the control module 110 executes program code to illuminate elements of the effect lighting 135 in a given pattern (certain lights are illuminated and distinguished in a pre-defined, timed, sequence), the functional lighting 132 is set, by the program code, to be off. When generating a state, a user may utilize the computing node 120 to select various settings for elements comprising the lighting fixture 130. The user may then utilize the computing node to save the settings (e.g., dimming of elements to certain levels, certain color temperatures). Upon saving certain presets, a user may select the presets (i.e., the newly created state) and one or more programs executed by the control module 110, based in this user selecting, implements these presets (i.e., the state) into the lighting elements of the lighting fixture 130.

As discussed above, by utilizing the computing node 120, a user may, through the control module 110, may implement changes to various settings of the functional lighting 132 and the effect lighting 135. Rather than define new pattern for implementation by the program code of the control node into the lighting elements of the lighting fixture 130, the user may utilize a computing node 120 to select one or more pre-existing programs, where each of the one or more programs implement a pattern into the effect lighting 135, when executed by the control module 110. In some embodiments of the present invention, a pre-existing program executed by the control module 110 may include a defined start time and stop time, which may be actual or relative.

The duration for a given program (whether pre-existing or user-defined) may be configurable by the user or pre-programmed into the control module 110. A user utilizing the computing node 120 may change the settings of the functional lighting 132 and the effect lighting 135 and implement patterns in the effect lighting 135, in real-time. In some embodiments of the present invention, a user may specify a temporal period for various settings and patterns and based in the user's inputs into the computing node 120, one or more programs may implement the lighting schedule specified.

Figure 3:
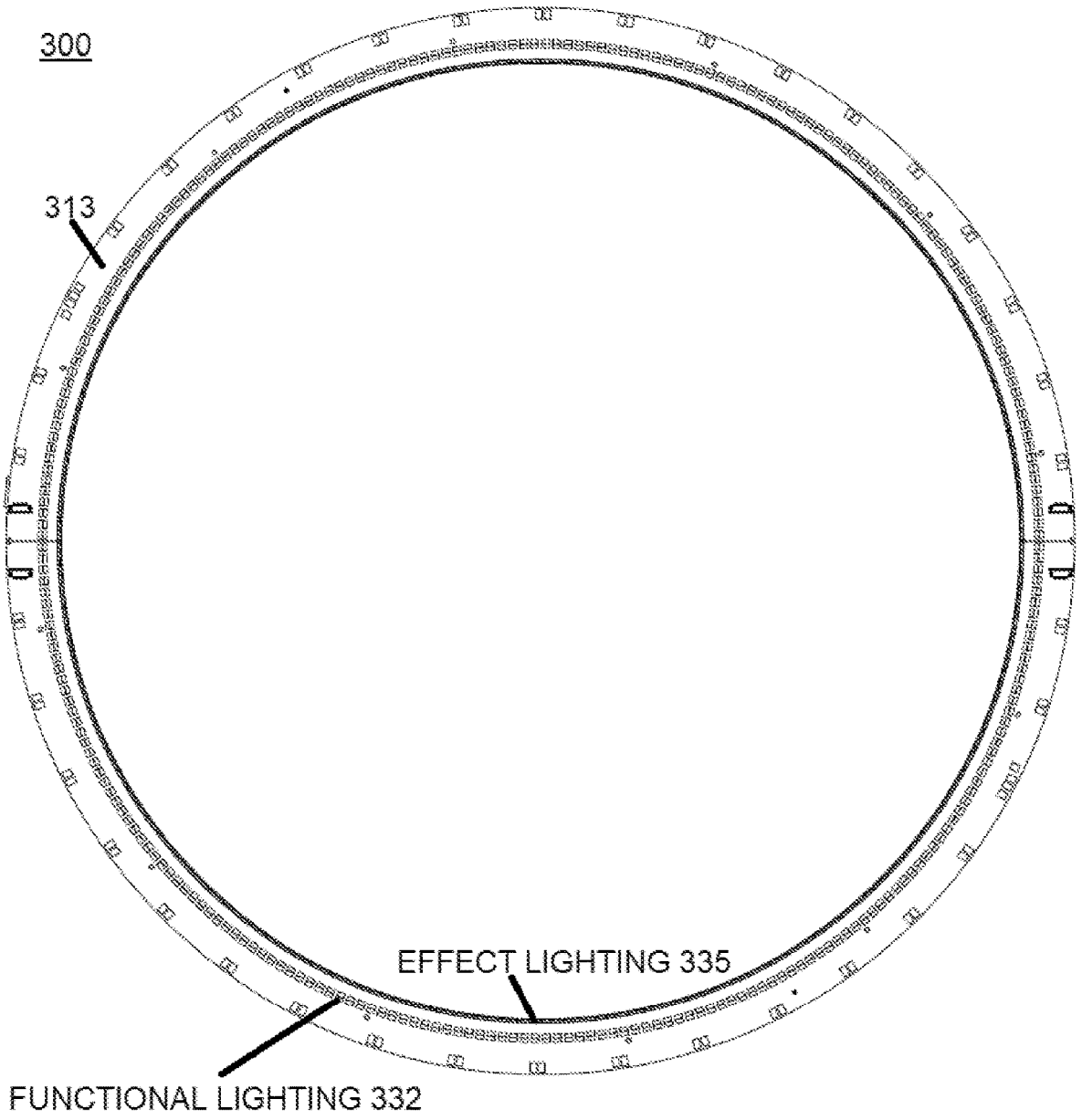
FIG. 3 depicts various aspects of a technical architecture that includes various aspects of some embodiments of the present invention.

FIG. 3 is an illustration of certain aspects of circuitry in a lighting fixture 300 of the present invention that includes both functional lighting 332 and effect lighting 335. The circuitry 300 is pictured from the bottom of the fixture. The circuitry of the lighting fixture 300 includes a single circuit board that is shaped like a ring 313 (in this non-limiting embodiment) to which the one or more circuits that control the functional lighting 332 and the effect lighting 335 are connected (in the pictured embodiment, two circuits are employed). The lighting elements that comprise the functional lighting 332 and the lighting elements that comprise the effect lighting 335, are separate, in this example, and are organized into a ring (e.g., of LEDs or OLEDs). The ring of lighting elements that comprises the functional lighting 332 is positioned to direct light in a downward direction. The downward positioning of the functional lighting 332 in this non-limiting example serves to illuminate a physical area, rendering the functional lighting 332 useful for various activities conducted in an illuminated space. In contrast, the ring of lighting elements that comprise the effect lighting 335 are positioned inward, toward the center of the ring 313. The elements of the effect lighting 335 are oriented at a right angle inward on the lighting fixture 300. As will be illustrated in FIG. 4, the effect lighting 335 that is positioned inward, toward the center of the ring 313, can be refracted through a refracting element or surface (see, e.g., FIG. 4, 490) such as a crystal or a prism, including a wall of crystal (see, e.g., FIG. 4, refracting element 490). In some embodiments of the present invention, both the effect lighting 335 and the functional lighting 332 may be passed through a refracting element.) As a result of the orientation of the effect lighting 335 in FIG. 3, an individual in a setting illuminated by a lighting fixture that includes aspects of circuitry in a lighting fixture 300 and the refracting element, pictured in FIG. 4, would look up and see an effect that would not interfere, visually or functionally, with the functional lighting 332. Patterns implemented by the one or more programs and executed by the effect lighting 335 would be enhanced by the refracting surface (e.g., FIG. 4, 490) positioned in front of the effect lighting 335. Although many of the figures depict effect lighting 335 oriented in one direction and functional lighting 332 oriented in another, both types of lighting may be oriented in the same direction, in some embodiments of the present invention. For example, in some embodiments of the present invention, both elements may be positioned to shine downward, for example, in embodiments of the present invention in which both functional and effect lighting is accomplished with common elements.

Figure 4:
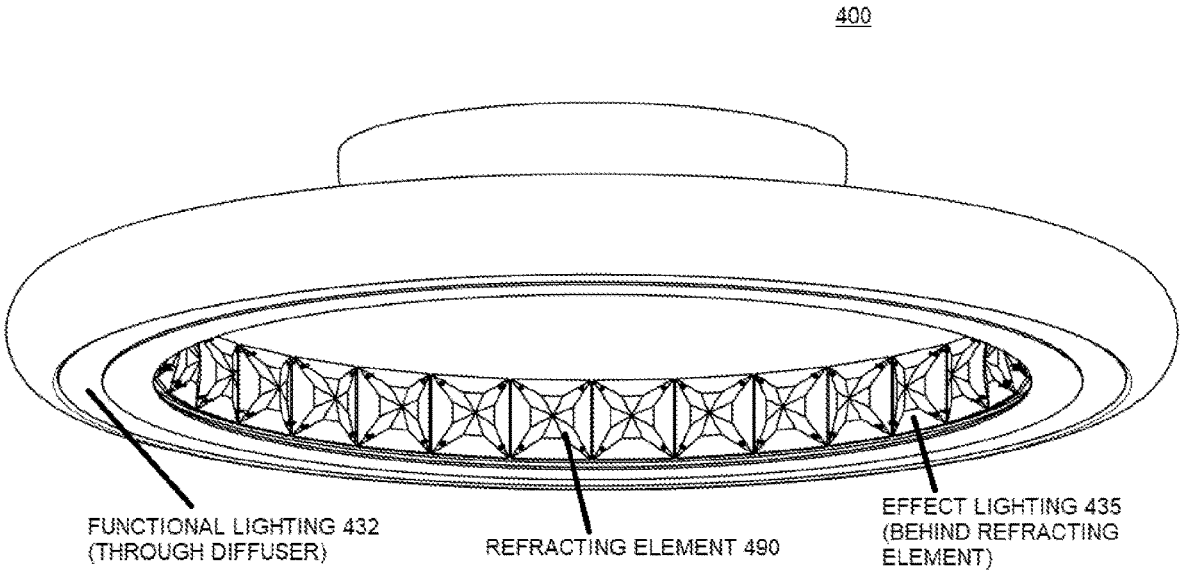
FIG. 4 depicts a lighting fixture that includes various aspects of some embodiments of the present invention.

FIG. 4 is an example of a lighting fixture 400 into which the aspects of circuitry in an embodiment of the present invention, such as the lighting fixture 300 of FIG. 3, have been implemented. As seen in FIG. 4, the effect lighting 435 is positioned to shine toward the center of the fixture 400, but is not fully visible in this figure because it is placed behind a refracting element 495, for example, a prism and/or a wall of crystal. The functional lighting 432, is positioned to point downward, and dispersed through a diffuser, in this example, in order to illuminate a designated area. Based on the positioning of the functional lighting 432 and the effect lighting 435, there is no (or minimal) light interference, leakage, or pollution between the functional lighting 432 and the effect lighting 435. In some embodiments of the present invention, the lighting fixture 400 may include gaskets (e.g., rubber) to aid in limiting and/or eliminating leakage between the functional lighting 432 and the effect lighting 435.

Figure 5:
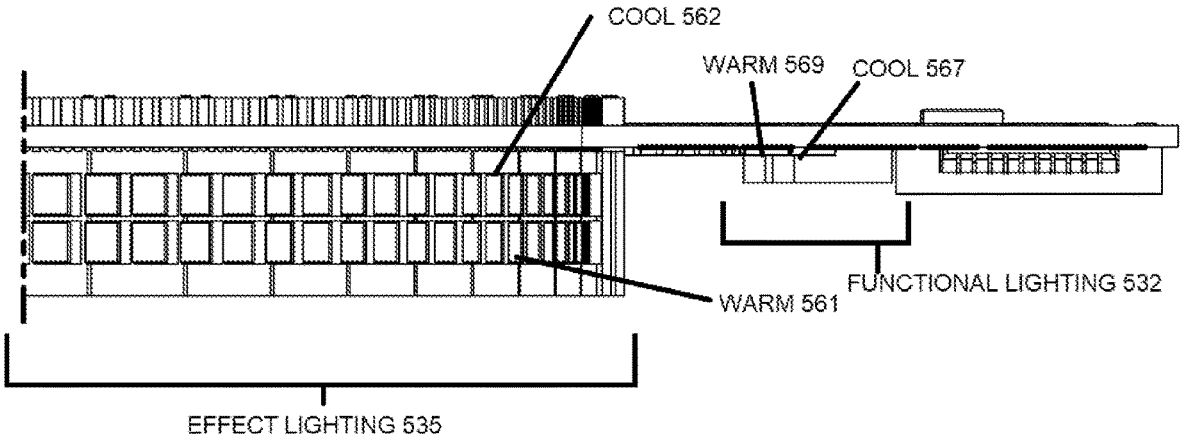
FIG. 5 depicts various aspects of a technical architecture that includes various aspects of some embodiments of the present invention.

FIG. 5 depicts a portion 500 of various aspects of the both the functional lighting 532 and the effect lighting 535 of embodiments of the present invention, when integrated into a fixture (e.g., FIG. 4, 400). In this embodiment, both the functional lighting 532 and the effect lighting 535 are comprised of LEDs of different temperatures. The functional lighting 532, which is directed downward for efficacy, includes both cool LEDs 567 and warm LEDs 569. The effect lighting 535, also includes both cool LEDs 562 and warm LEDs 561. The effect lighting 535 is positioned to cast light generally in a direction that is horizontal to the axis upon which each LED is affixed. The difference in the direction of the effect light 535 and the functional light 535 maintains the separate functionality, visually, as explained in reference to FIG. 4. FIG. 5 is merely one example of a configuration and selection of lighting elements to comprise both the functional lighting 532 and effect lighting 535. Varying the number and types of lighting elements that comprise the effect lighting 535 enable the implementation of many different patterns within the lighting fixture (e.g., 400).

With the portion 500 in FIG. 5 in mind, certain patterns, comprised of one or more programs, which may be implemented by software and hardware, based on receiving an instruction from a computing node (e.g., FIG. 1, 120), can be understood. Overall, various patterns may include changing the color temperature, but not the color, of various elements comprising the effect lighting 532 and the functional lighting 535. Patterns implemented in embodiments of the present invention may not include changing the color of various lighting elements because implementing a refracting element (e.g., FIG. 4, 495) provides the color differentiation/separation sought. Thus, color elements in embodiments of the present invention may be provided by refraction of the effect lighting 532, rather than by utilizing lighting elements in the effect lighting 532 that provide color changing functionality.

Figure 6:
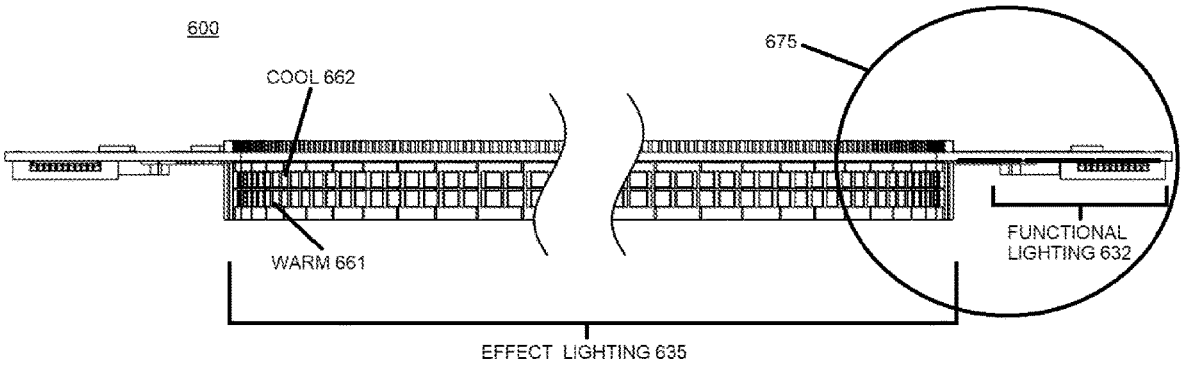
FIG. 6 depicts various aspects of a technical architecture that includes various aspects of some embodiments of the present invention.

Certain patterns may involve varying the behavior of various LEDs (or other lighting elements, depending on the embodiment). For example, one pattern may allow the effect lighting 535 in the fixture 500 to look like a firefly. When a user selects a "firefly" program at a computing node, responsive to this selection, one or more programs in the control module may turn the functional lighting 532 off and select a group of lighting elements comprising the effect lighting 535 that are of a lower temperature, when compared to other elements, and turn certain of those elements on and off, individually, in a seemingly random order. The one or more programs may repeat this pattern. Because the functional light 532 is not on, the blinking effect of the effect lighting 535 will arguably take on the appearance of a firefly. A refractor (e.g., FIG. 4, 495), may be utilized to intensify this effect. Alternatively or additionally, in fixtures where the effect lighting 535 is situated in rings in order of temperature, as seen with the cool lighting elements 562 and the warm lighting elements 561, a pattern can be implemented in the programmable lighting elements where the lighting elements that comprise the effect lighting 535 will alternate in a way where they appear to chase each other and the program will terminate or repeat after the elements of a certain color temperature are illuminated by the program code. The visual impact of the execution of the one or more programs that implement patterns in the effect lighting 535 can be understood by referring to FIG. 6. FIG. 6 includes a full cross-section 600 of lighting elements and certain circuit elements included in some embodiments of the present invention. A portion 675 of FIG. 6 is the portion 500 of FIG. 5. In some embodiments of the present invention, an infinity mirror may be placed in the fixture to create an illusion of more lighting elements comprising the effect lighting 635. In some embodiments of the present invention, the fixture includes a two-way mirror. Specifically, the bottom of the fixture comprises a two-way mirror. In some embodiments of the present invention, the light source for the effect lighting 635 is behind a refracting element (e.g., FIG. 4, 490), which sits between a view of the fixture and an infinity effect. Thus, a viewer views the lighting effect through the two-way mirror. The refracting element and the infinity effect amplify the effect lighting, which is seen through the two way mirror, by the viewer. By using the two-way mirror to create the infinity effect, an observer will see, through the mirror, multiple copies of each individual elements that comprises the effect lighting 635, which will amplify the impact of the programmable lighting effect being implemented by one or more programs.

Figure 7:
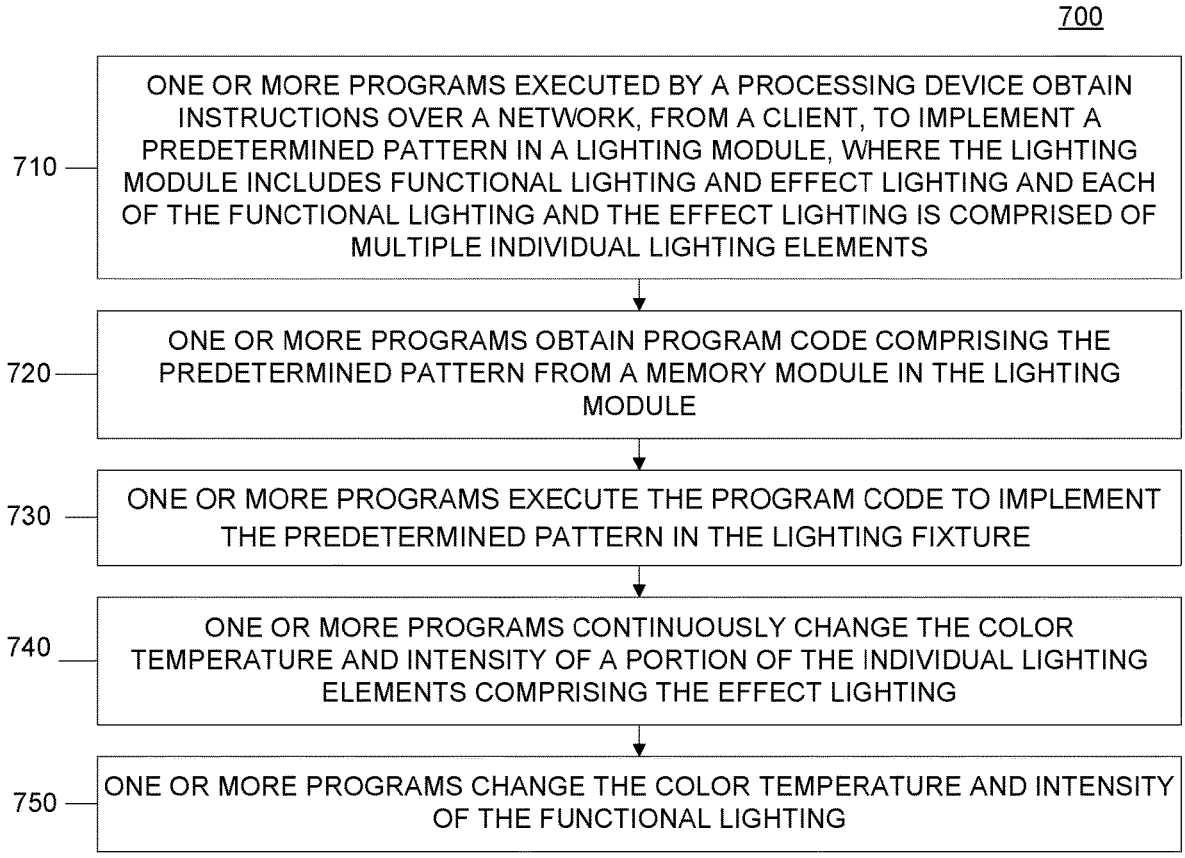
FIG. 7 illustrates a workflow that includes various aspects of some embodiments of the present invention.

FIG. 7 depicts a workflow 700 that can be executed by various aspects of some embodiments of the present invention. In some embodiments of the present invention, one or more programs executed by a processing device obtain instructions over a network, from a client, to implement a predetermined pattern in a lighting module, where the lighting module includes functional lighting and effect lighting and each of the functional lighting and the effect lighting is comprised of multiple individual lighting elements (710). Based on obtaining this instruction, the one or more programs obtain program code comprising the predetermined pattern from a memory module in the lighting module (720). The one or more programs execute the program code to implement the predetermined pattern in the lighting fixture (730). Based on executing the program code, the one or more programs continuously change the color temperature and intensity of a portion of the individual lighting elements comprising the effect lighting (740). Based on executing the program code, the one or more programs change the color temperature and intensity of the functional lighting (750). In some embodiments of the present invention, the one or more programs may operate various elements at different times, based on the pattern implemented by executing the program code. Based on executing the program code, the one or more programs change the color temperature or intensity of the functional lighting. In some embodiments of the present invention, executing a pattern may only change one or more of the functional lighting or the effect lighting. In embodiments of the present invention, the implementation of a given pattern by one or more programs appears, to a viewer of the fixture, to occur in real-time. Any changes to the functional lighting or the effect lighting may be implemented by the one or more programs concurrently and/or in parallel. The elements that comprise the effect lighting and the functional lighting are selected based on the ability of these lights to implement the commands that comprise the program code in the pattern, seemingly, instantly.

Some embodiments of the present invention include a lighting fixture that includes one or more processing circuits, a lighting module communicatively coupled to the one or more processing circuits, which includes a first plurality of lighting elements comprising effect lighting communicatively coupled to the computing node, a second plurality of lighting elements comprising functional lighting communicatively coupled to the computing node, wherein the lighting elements comprising the second plurality are oriented to illuminate a surface below the lighting fixture, and a memory, in communication with the one or more processing circuits, wherein the memory comprises registers, wherein the registers store one or more programs comprising lighting patterns, wherein each lighting pattern comprises a sequence for illuminating a portion of lighting elements comprising the first plurality of lighting elements, in a predefined order, and program instructions executable by the one or more processing circuits, via the memory to perform a method. The method includes the one or more processing circuits obtaining, from a client, via a network, a request to implement a specified lighting pattern. The one or more processing circuits identify, in the memory, one or more programs comprising the specified lighting pattern from the one or more programs comprising lighting patterns. The one or more processing circuits executed the identified one or more programs comprising the specified lighting pattern, where the executing comprises implementing the specified lighting pattern in the lighting module.

In some embodiments of the present invention, the lighting fixture may include a refractive element positioned proximate to the first plurality of lighting elements to refract light from the first plurality of lighting elements. The refractive element may be a prism, a crystal, a wall of crystal, and/or refractive glass.

In some embodiments of the present invention, each lighting pattern includes instructions for adjusting a setting of the portion of lighting elements comprising the first plurality of lighting elements, the setting selected from the group consisting of: intensity and color temperature.

In some embodiments of the present invention, each lighting pattern includes instructions for adjusting a setting of the second plurality of lighting elements, the setting selected from the group consisting of: intensity and color temperature.

In some embodiments of the present invention, the one or more processing circuits obtain, from a computing resource of a distributed computing system, via the network, an additional one or more programs comprising additional lighting patterns. The one or more processing circuits store the additional one or more programs in the memory. The specified program may have originated as one of the additional programs.

In some embodiments of the present invention, the first plurality of lighting elements are selected from the group consisting of: light emitting diodes and organic light-emitting diodes.

In some embodiments of the present invention, the second plurality of lighting elements are selected from the group consisting of: light emitting diodes and organic light-emitting diodes.

In some embodiments of the present invention, the first plurality of lighting elements and the second plurality of lighting elements are common lighting elements.

In some embodiments of the present invention, the lighting module includes a first circuit and a second circuit and the first plurality of lighting elements are coupled to the first circuit and the second plurality of lighting elements are coupled to the second circuit.

In some embodiments of the present invention, each lighting pattern also includes instructions for adjusting a setting of the second plurality of lighting elements, the setting selected from the group consisting of: on and off.

In some embodiments of the present invention, the first plurality of lighting elements are oriented to illuminate in a direction at a right angle from an orientation of the second plurality of lighting elements.

In some embodiments of the present invention, the first plurality of lighting elements and the first plurality of lighting elements comprise lighting elements of a first color temperature and lighting elements of a second color temperature.

In some embodiments of the present invention, each lighting pattern includes timing parameters to indicate when to terminate implementation of the lighting pattern in the lighting module.

Some embodiments of the present invention include computer-implemented methods and a computer program products that include one or more programs executed by one or more processors that obtain, from a client, via a network, a request to implement a specified lighting pattern in one or more lighting fixtures. Each lighting fixture includes a first plurality of lighting elements including effect lighting communicatively coupled to the one or more processors and a second plurality of lighting elements comprising functional lighting communicatively coupled to the one or more processor, where the lighting elements comprising the second plurality are oriented to illuminate a surface below the lighting fixture. The one or more programs identify, in a memory communicatively coupled to the one or more processing circuits, one or more programs comprising the specified lighting pattern from the one or more programs comprising lighting patterns, wherein the specified lighting pattern comprises a sequence for illuminating a portion of lighting elements comprising the first plurality of lighting elements, in a predefined order. The one or more programs execute the identified one or more programs comprising the specified lighting pattern, where the executing includes implementing the specified lighting pattern in the one or more lighting fixtures.

In some embodiments of the present invention, implementing the specified lighting pattern in the one or more lighting fixtures includes one or more programs automatically adjusting a setting of the portion of lighting elements comprising the first plurality of lighting elements in each of the one or more lighting fixtures, the setting selected from the group consisting of: intensity and color temperature.

In some embodiments of the present invention, implementing the specified lighting pattern in the one or more lighting fixtures includes the one or more programs automatically adjusting a setting of the second plurality of lighting elements in each of the one or more lighting fixtures, the setting selected from the group consisting of: intensity and color temperature.

In some embodiments of the present invention, implementing the specified lighting pattern in the one or more lighting fixtures includes the one or more programs automatically adjusting a setting of the second plurality of lighting elements in each of the one or more lighting fixtures, the setting selected from the group consisting of: on and off.

In some embodiments of the present invention, the specified lighting pattern includes timing parameters to indicate when to terminate implementation of the lighting pattern in the lighting module.

In some embodiments of the present invention, the one or more programs generate the specified pattern by obtaining, from the client, via entry on the client in a graphical user interface, the sequence for illuminating the portion of lighting elements comprising the first plurality of lighting elements, in the predefined order. The one or more programs store the sequence, as the specified pattern, in the memory.

Figure 8:
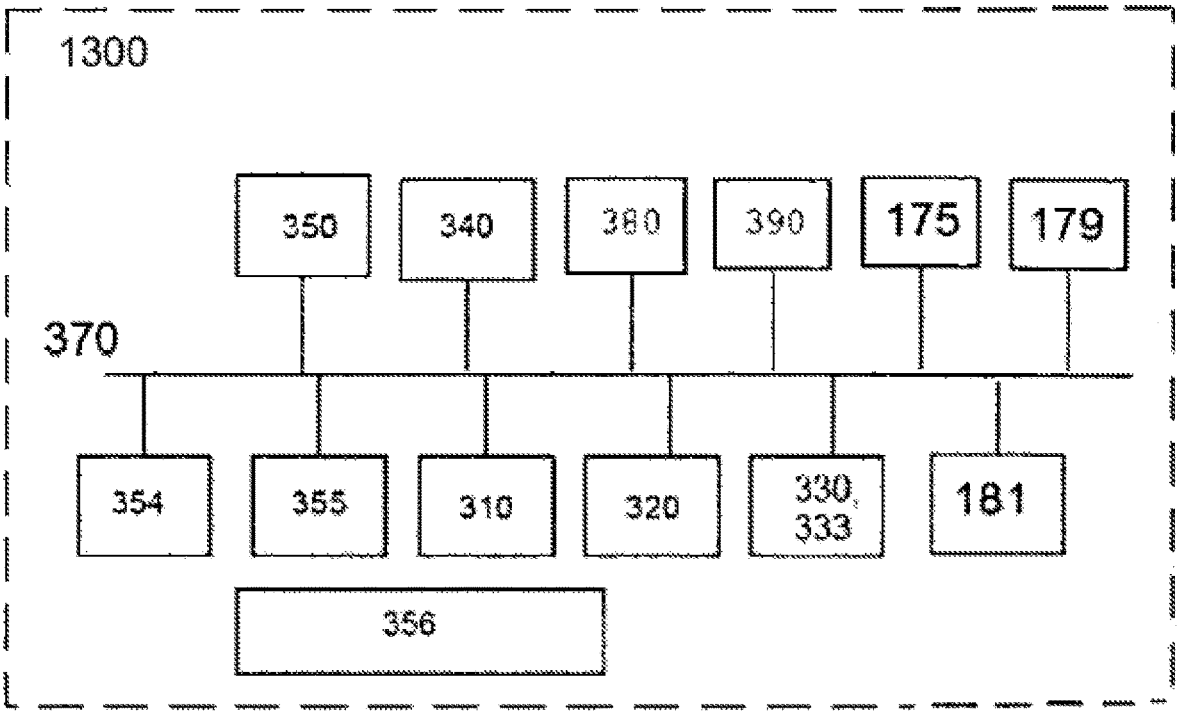
FIG. 8 depicts one embodiment of a single processor computing environment, which may comprise a node of a cloud computing environment, to incorporate and use one or more aspects of the present invention.

FIG. 8 illustrates a block diagram of a resource 1300 in computer system, such as control module 110 and computing node 120, which are part of the technical architecture of certain embodiments of the technique. The resource 1300 may include a circuitry 370 that may in certain embodiments include a microprocessor 354. The computer system 1300 may also include a memory 355 (e.g., a volatile memory device), and storage 181. The storage 181 may include a non-volatile memory device (e.g., EPROM, ROM, PROM, RAM, DRAM, SRAM, flash, firmware, programmable logic, etc.), magnetic disk drive, optical disk drive, tape drive, etc. The storage 355 may comprise an internal storage device, an attached storage device and/or a network accessible storage device. The system 1300 may include a program logic 330 including code 333 that may be loaded into the memory 355 and executed by the microprocessor 356 or circuitry 370.

In certain embodiments, the program logic 330 including code 333 may be stored in the storage 181, or memory 355. In certain other embodiments, the program logic 333 may be implemented in the circuitry 370. Therefore, while FIG. 2 shows the program logic 333 separately from the other elements, the program logic 333 may be implemented in the memory 355 and/or the circuitry 370.

Using the processing resources of a resource 1300 to execute software, computer-readable code or instructions, does not limit where this code can be stored.

Figure 9:
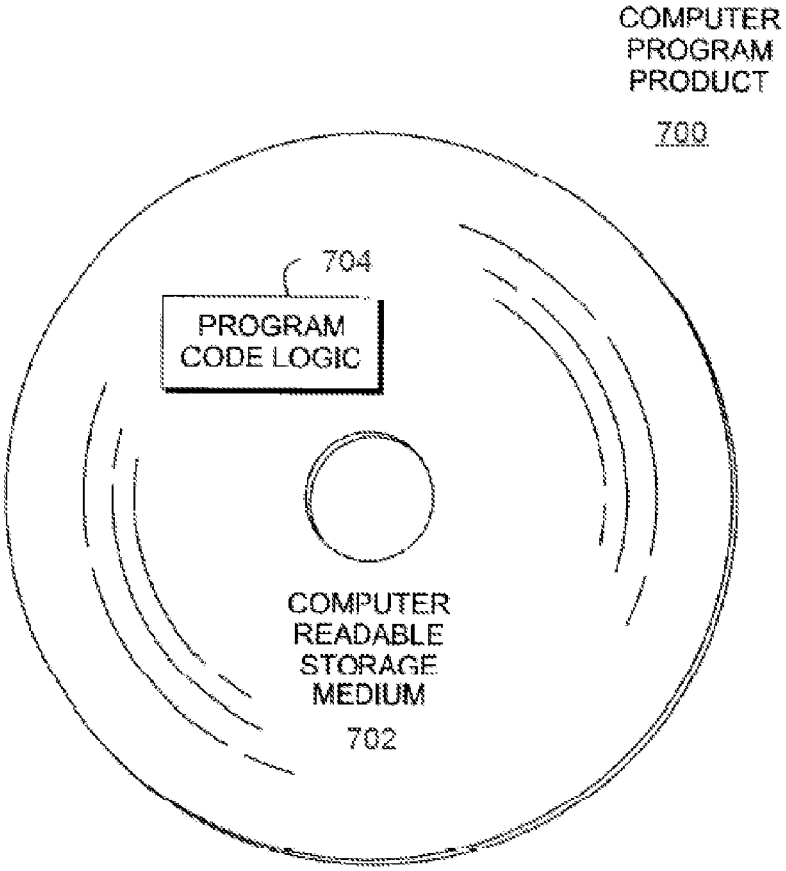
FIG. 9 depicts one embodiment of a computer program product incorporating one or more aspects of the present invention.

Referring to FIG. 9, in one example, a computer program product 700 includes, for instance, one or more non-transitory computer readable storage media 702 to store computer readable program code means or logic 704 thereon to provide and facilitate one or more aspects of the technique.

As will be appreciated by one skilled in the art, aspects of the technique may be embodied as a system, method or computer program product. Accordingly, aspects of the technique may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the technique may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable signal medium may include a propagated data signal with computer readable program code embodied therein, for example, in baseband or as part of a carrier wave. Such a propagated signal may take any of a variety of forms, including, but not limited to, electro-magnetic, optical or any suitable combination thereof. A computer readable signal medium may be any computer readable medium that is not a computer readable storage medium and that can communicate, propagate, or transport a program for use by or in connection with an instruction execution system, apparatus or device.

A computer readable storage medium may be, for example, but not limited to, an electronic, magnetic, optical, electromagnetic, infrared or semiconductor system, apparatus, or device, or any suitable combination of the foregoing. More specific examples (a non-exhaustive list) of the computer readable storage medium include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

Program code embodied on a computer readable medium may be transmitted using an appropriate medium, including but not limited to wireless, wireline, optical fiber cable, RF, etc., or any suitable combination of the foregoing.

Computer program code for carrying out operations for aspects of the technique may be written in any combination of one or more programming languages, including an object oriented programming language, such as Java, Smalltalk, Java, Python, R-Language, C++ or the like, and conventional procedural programming languages, such as the "C" programming language, assembler or similar programming languages. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the technique are described herein with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions, also referred to as computer program code, may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

In addition to the above, one or more aspects of the technique may be provided, offered, deployed, managed, serviced, etc. by a service provider who offers management of customer environments. For instance, the service provider can create, maintain, support, etc. computer code and/or a computer infrastructure that performs one or more aspects of the technique for one or more customers. In return, the service provider may receive payment from the customer under a subscription and/or fee agreement, as examples. Additionally or alternatively, the service provider may receive payment from the sale of advertising content to one or more third parties.

In one aspect of the technique, an application may be deployed for performing one or more aspects of the technique. As one example, the deploying of an application comprises providing computer infrastructure operable to perform one or more aspects of the technique.

As a further aspect of the technique, a computing infrastructure may be deployed comprising integrating computer readable code into a computing system, in which the code in combination with the computing system is capable of performing one or more aspects of the technique. As a further aspect of the technique, the system can operate in a peer to peer mode where certain system resources, including but not limited to, one or more databases, is/are shared, but the program code executable by one or more processors is loaded locally on each computer (workstation).

As yet a further aspect of the technique, a process for integrating computing infrastructure comprising integrating computer readable code into a computer system may be provided. The computer system comprises a computer readable medium, in which the computer medium comprises one or more aspects of the technique. The code in combination with the computer system is capable of performing one or more aspects of the technique.

Further, other types of computing environments can benefit from one or more aspects of the technique. As an example, an environment may include an emulator (e.g., software or other emulation mechanisms), in which a particular architecture (including, for instance, instruction execution, architected functions, such as address translation, and architected registers) or a subset thereof is emulated (e.g., on a native computer system having a processor and memory). In such an environment, one or more emulation functions of the emulator can implement one or more aspects of the technique, even though a computer executing the emulator may have a different architecture than the capabilities being emulated. As one example, in emulation mode, the specific instruction or operation being emulated is decoded, and an appropriate emulation function is built to implement the individual instruction or operation.

In an emulation environment, a host computer includes, for instance, a memory to store instructions and data; an instruction fetch unit to fetch instructions from memory and to optionally, provide local buffering for the fetched instruction; an instruction decode unit to receive the fetched instructions and to determine the type of instructions that have been fetched; and an instruction execution unit to execute the instructions. Execution may include loading data into a register from memory; storing data back to memory from a register; or performing some type of arithmetic or logical operation, as determined by the decode unit. In one example, each unit is implemented in software. For instance, the operations being performed by the units are implemented as one or more subroutines within emulator software.

Further, a data processing system suitable for storing and/or executing program code is usable that includes at least one processor coupled directly or indirectly to memory elements through a system bus. The memory elements include, for instance, local memory employed during actual execution of the program code, bulk storage, and cache memory which provide temporary storage of at least some program code in order to reduce the number of times code must be retrieved from bulk storage during execution.

Input/Output or I/O devices (including, but not limited to, keyboards, displays, pointing devices, DASD, tape, CDs, DVDs, thumb drives and other memory media, etc.) can be coupled to the system either directly or through intervening I/O controllers. Network adapters may also be coupled to the system to enable the data processing system to become coupled to other data processing systems or remote printers or storage devices through intervening private or public networks. Modems, cable modems, and Ethernet cards are just a few of the available types of network adapters.

Embodiments of the present invention may be implemented in cloud computing systems. FIG. 10 may also comprise a node in this type of computing environment.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components and/or groups thereof.

The corresponding structures, materials, acts, and equivalents of all means or step plus function elements in the descriptions below, if any, are intended to include any structure, material, or act for performing the function in combination with other elements as specifically noted. The description of the technique has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A lighting fixture comprising:

one or more processing circuits;

a lighting module communicatively coupled to the one or more processing circuits, comprising:

a first plurality of lighting elements comprising effect lighting communicatively coupled to a computing node;

a second plurality of lighting elements comprising functional lighting communicatively coupled to the computing node, wherein the lighting elements comprising the second plurality of lighting elements are oriented at an orientation to illuminate a surface below the lighting fixture;

a first circuit and a second circuit, wherein the first plurality of lighting elements is coupled to the first circuit and the second plurality of lighting elements is coupled to the second circuit;

a memory, in communication with the one or more processing circuits, wherein the memory comprises registers, wherein the registers store one or more programs comprising lighting patterns, wherein each lighting pattern comprises a sequence for illuminating a portion of lighting elements comprising the first plurality of lighting elements, in a predefined order; and a refractive element positioned proximate to the first plurality of lighting elements to refract light from the first plurality of lighting elements, the refractive element orienting the first plurality of lighting elements to illuminate in a different direction than the orientation of the second plurality of lighting elements; and program instructions executable by the one or more processing circuits, via the memory to perform a method, the method comprising:

obtaining, by the one or more processing circuits, from a client, via a network, a request to implement a specified lighting pattern;

identifying, by the one or more processing circuits, in the memory, one or more programs comprising the specified lighting pattern from the one or more programs comprising lighting patterns; and executing, by the one or more processing circuits, the identified one or more programs comprising the specified lighting pattern, wherein the executing comprises implementing the specified lighting pattern in the lighting module.

2. The lighting fixture of claim 1, wherein the second plurality of lighting elements is not refracted by the refractive element positioned proximate to the first plurality of lighting elements.

3. The lighting fixture of claim 1, wherein the refractive element is selected from the group consisting of: a prism, a crystal, a wall of crystal, and refractive glass.

4. The lighting fixture of claim 1, wherein each lighting pattern further comprises instructions for adjusting a setting of the portion of lighting elements comprising the first plurality of lighting elements, the setting selected from the group consisting of: intensity and color temperature.

5. The lighting fixture of claim 1, wherein each lighting pattern further comprises instructions for adjusting a setting of the second plurality of lighting elements, the setting selected from the group consisting of: intensity and color temperature.

6. The lighting fixture of claim 1, the method further comprising:

obtaining, by the one or more processing circuits, from a computing resource of a distributed computing system, via the network, an additional one or more programs comprising additional lighting patterns; and storing, by the one or more processing circuits, the additional one or more programs in the memory.

7. The lighting fixture of claim 6, wherein the specified pattern comprises one or more programs of the additional one or more programs.

8. The lighting fixture of claim 1, wherein the first plurality of lighting elements is selected from the group consisting of: light emitting diodes and organic light-emitting diodes.

9. The lighting fixture of claim 1, wherein the second plurality of lighting elements are selected from the group consisting of: light emitting diodes and organic light-emitting diodes.

10. The lighting fixture of claim 1, wherein the first plurality of lighting elements and the second plurality of lighting elements comprise common lighting elements.

11. The lighting fixture of claim 1, wherein each lighting pattern further comprises instructions for adjusting a setting of the second plurality of lighting elements, the setting selected from the group consisting of: on and off.

12. The lighting fixture of claim 1, wherein the different direction is at a right angle from the orientation of the second plurality of lighting elements.

13. The lighting fixture of claim 1, wherein the first plurality of lighting elements and the second plurality of lighting elements comprise lighting elements of a first color temperature and lighting elements of a second color temperature, respectively.

14. The lighting fixture of claim 1, wherein each lighting pattern further comprises timing parameters to indicate when to terminate implementation of the lighting pattern in the lighting module.

15. A computer-implemented method, comprising:

obtaining, by one or more processing circuits, from a client, via a network, a request to implement a specified lighting pattern in one or more lighting fixtures, wherein each lighting fixture comprises:

a first plurality of lighting elements comprising effect lighting communicatively coupled to the one or more processing circuits;

a second plurality of lighting elements comprising functional lighting communicatively coupled to the computing node, wherein the lighting elements comprising the second plurality of lighting elements are oriented at an orientation to illuminate a surface below the lighting fixture;

a first circuit and a second circuit, wherein the first plurality of lighting elements is coupled to the first circuit and the second plurality of lighting elements is coupled to the second circuit; and a refractive element positioned proximate to the first plurality of lighting elements to refract light from the first plurality of lighting elements, the refractive element orienting the first plurality of lighting elements to illuminate in a different direction than the orientation of the second plurality of lighting elements; and identifying, by the one or more processing circuits, in a memory communicatively coupled to the one or more processing circuits, one or more programs comprising the specified lighting pattern from the one or more programs comprising lighting patterns, wherein the specified lighting pattern comprises a sequence for illuminating a portion of lighting elements comprising the first plurality of lighting elements, in a predefined order; and executing, by the one or more processing circuits, the identified one or more programs comprising the specified lighting pattern, wherein the executing comprises implementing the specified lighting pattern in the one or more lighting fixtures.

16. The computer-implemented method of claim 15, wherein implementing the specified lighting pattern in the one or more lighting fixtures comprises automatically adjusting a setting of the portion of lighting elements comprising the first plurality of lighting elements in each of the one or more lighting fixtures, the setting selected from the group consisting of: intensity and color temperature.

17. The computer-implemented method of claim 15, wherein implementing the specified lighting pattern in the one or more lighting fixtures comprises automatically adjusting a setting of the second plurality of lighting elements in each of the one or more lighting fixtures, the setting selected from the group consisting of: intensity and color temperature.

18. The computer-implemented method of claim 15, wherein implementing the specified lighting pattern in the one or more lighting fixtures comprises automatically adjusting a setting of the second plurality of lighting elements in each of the one or more lighting fixtures, the setting selected from the group consisting of: on and off.

19. A computer program product comprising:

a non-transitory computer readable storage medium readable by one or more processing circuits in a distributed computing environment, and storing instructions for execution by the one or more processing circuits for performing a method comprising:

obtaining, by one or more processing circuits, from a client, via a network, a request to implement a specified lighting pattern in one or more lighting fixtures, wherein each lighting fixture comprises:

a first plurality of lighting elements comprising effect lighting communicatively coupled to the one or more processing circuits;

a second plurality of lighting elements comprising functional lighting communicatively coupled to the computing node, wherein the lighting elements comprising the second plurality of lighting elements are oriented at an orientation to illuminate a surface below the lighting fixture;

a first circuit and a second circuit, wherein the first plurality of lighting elements is coupled to the first circuit and the second plurality of lighting elements is coupled to the second circuit; and a refractive element positioned proximate to the first plurality of lighting elements to refract light from the first plurality of lighting elements, the refractive element orienting the first plurality of lighting elements to illuminate in a different direction than the orientation of the second plurality of lighting elements; and identifying, by the one or more processing circuits, in a memory communicatively coupled to the one or more processing circuits, one or more programs comprising the specified lighting pattern from the one or more programs comprising lighting patterns, wherein the specified lighting pattern comprises a sequence for illuminating a portion of lighting elements comprising the first plurality of lighting elements, in a predefined order; and executing, by the one or more processing circuits, the identified one or more programs comprising the specified lighting pattern, wherein the executing comprises implementing the specified lighting pattern in the one or more lighting fixtures.

* * * * *